United States Patent [19]

Walker

[11] 3,955,841

[45] May 11, 1976

[54] HOLDING BAR FOR A CLOSURE

[76] Inventor: Brooks Walker, 807 Francisco St., San Francisco, Calif. 94109

[22] Filed: Mar. 4, 1974

[21] Appl. No.: 448,001

[52] U.S. Cl. ..... 292/259 R; 292/262

[51] Int. Cl.[2] ..... E05C 3/00; E05C 17/14

[58] Field of Search ..... 292/259, 262, 260, 275, 292/276, 277, 278, 263, 108, 101

[56] References Cited

UNITED STATES PATENTS

| | | | |
|---|---|---|---|
| 174,639 | 3/1876 | Parsons | 16/128 R |
| 1,482,643 | 2/1924 | Etheridge | 292/101 |
| 1,593,928 | 7/1926 | Carrier | 16/128 R |
| 2,150,746 | 3/1939 | Nampa | 292/108 X |
| 2,163,206 | 6/1939 | Lopez | 292/259 |
| 2,919,945 | 1/1960 | Tannen | 292/262 |
| 3,328,920 | 7/1967 | Cohen et al. | 292/262 X |
| 3,690,709 | 9/1972 | Bogusz | 292/247 |

*Primary Examiner*—Richard E. Moore
*Attorney, Agent, or Firm*—Gordon Wood

[57] ABSTRACT

A safety bar for holding a closure such as a door in its locked position or in a partially opened position to enhance security. A bar for holding the closure in either position is provided together with keepers cooperating with the bar to perform the holding function.

7 Claims, 29 Drawing Figures

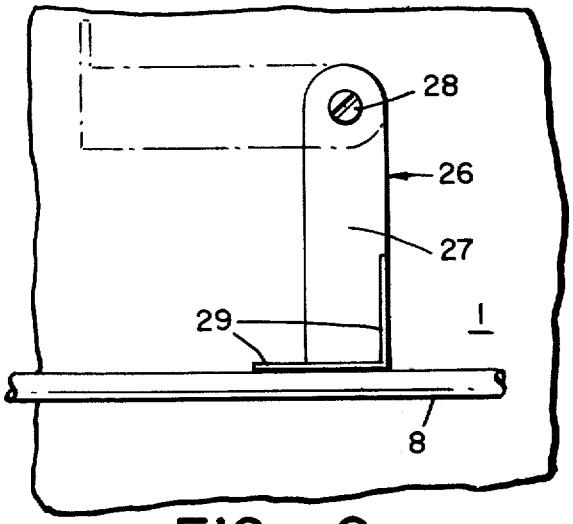
FIG_6
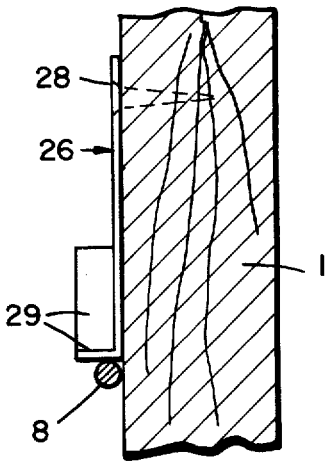
FIG_7
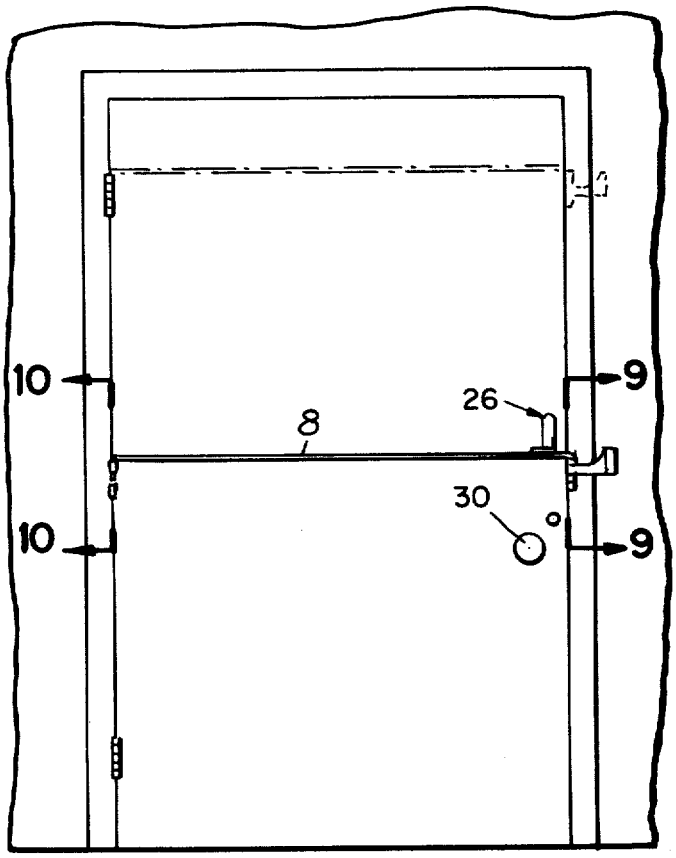
FIG_8
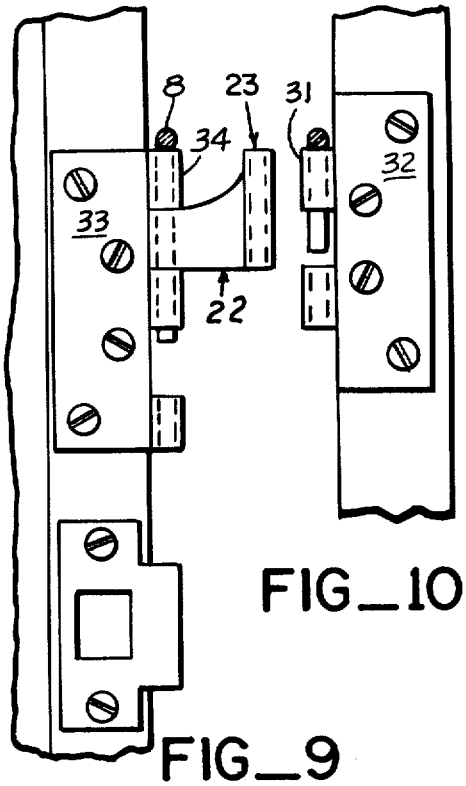
FIG_10
FIG_9
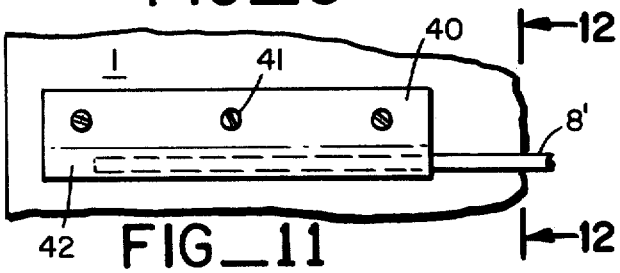
FIG_11
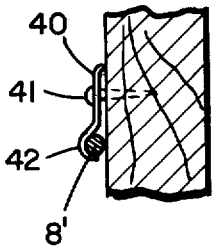
FIG_12

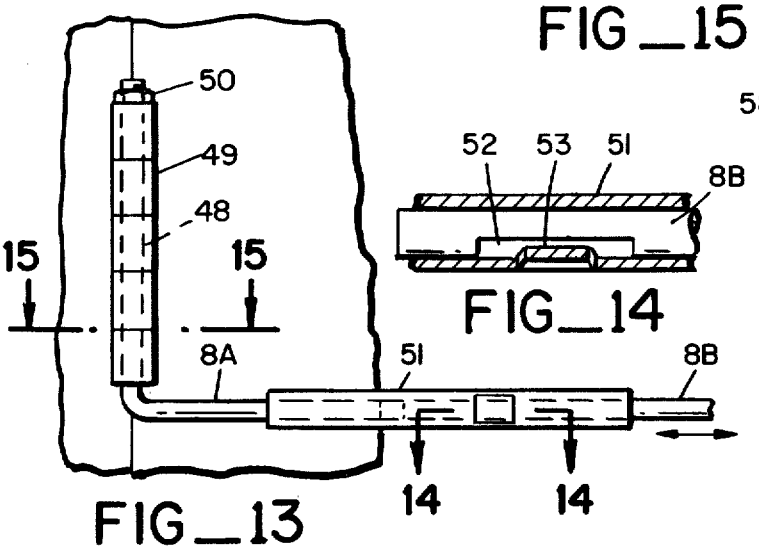
FIG_13
FIG_14
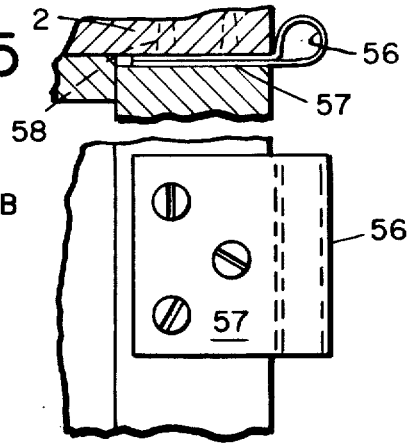
FIG_15
FIG_16
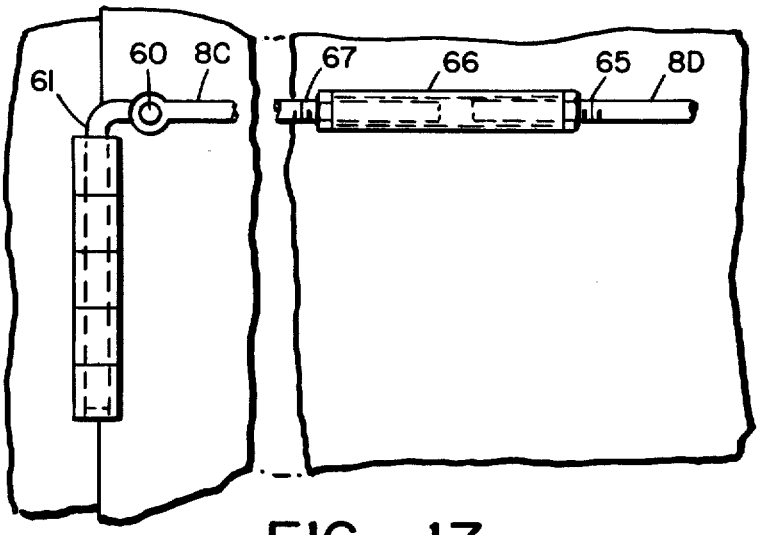
FIG_17
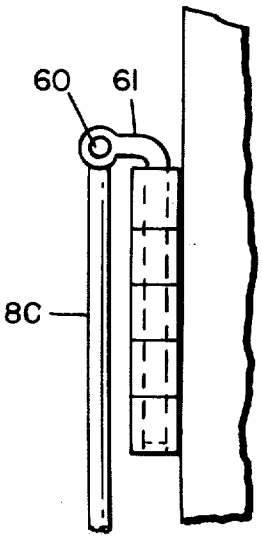
FIG_18
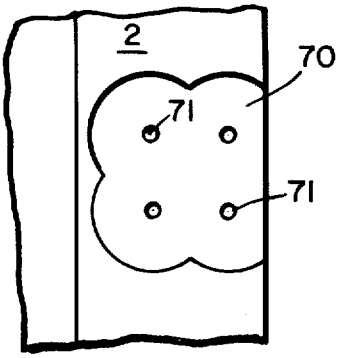
FIG_19
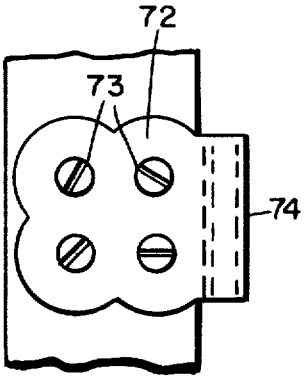
FIG_20
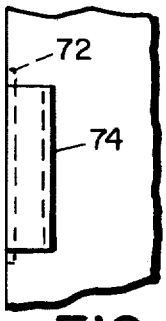
FIG_21
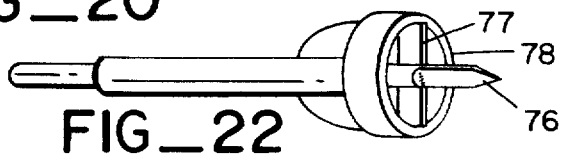
FIG_22

HOLDING BAR FOR A CLOSURE

This invention relates to a safety bar for holding a closure in a closure structure such as a door or window in either a closed locked position or partially opened position. When holding the door in closed position, the bar provides additional security over that derived from the use of conventional door locks, latches, chains and the like. When holding the closure in a partially opened position it again provides security for the user and permits him to speak through the opening between the closure and the frame without permitting the closure to be swung past the partially opened position.

The main object of the present invention is to provide a bar of the above described nature which is easily installed and which at the same time provides optimum security for the occupant of the house or apartment using the same.

Heretofore, it has been customary to provide a secondary door holding means in addition to the customary door lock or latch. Such prior art holding means has generally comprised a chain which is secured at one end to the door frame and adapted to be secured at its other end to a slotted member on the door to permit the door to be held in a partially opened position against further opening by a person outside the door. Such chain devices are characteristically weak in construction and the screws holding the chain attaching elements are usually placed in a manner so as not to provide a great amount of resistance against the door being pushed or kicked further open from the outside.

Another object of the invention is the provision of a door holding means which constitutes an improvement over the prior art in that the same is stronger than analogous devices heretofore available.

Other objects and advantages will be apparent from the following specification and from the drawngs;

FIG. 6 is a fragmentary side elevational view of the door showing the locking means for holding the bar in its door holding position.

FIG. 7 is a vertical cross sectional view through the door showing the locking means of FIG. 6.

FIG. 8 is a side elevation similar to FIG. 1 showing another form of the invention.

FIG. 9 is a side elevation of the inner side of the door frame at the latch edge of the door showing the keeper.

FIG. 10 is a fragmentary side elevation of the door frame adjacent the hinge edge of the door showing one method of connecting the holding bar to the closure structure.

FIG. 11 is a fragmentary side elevation of the inside of the door showing another means for securing the holding bar to the closure structure.

FIG. 12 is a vertical cross section through the door showing the structure of FIG. 11.

FIG. 13 is a fragmentary side elevation of the inside of the door showing another method of securing the holding bar and showing an adjustment means for the same.

FIG. 14 is an enlarged horizontal section through the adjustment means taken in a plane indicated by lines 14—14 of FIG. 13.

FIG. 15 is a horizontal section as through the closure structure showing another form of keeper.

FIG. 16 is a side elevation of the keeper of FIG. 15.

FIG. 17 is a view similar to FIG. 13 showing still another form of the holding bar including means for adjusting the effective length of the same.

FIG. 18 is a side elevation of the structure of FIG. 17.

FIG. 19 is a side elevation of the frame at the hinge edge of the closure showing the manner in which the frame is recessed to receive one form of the safety bar supporting means.

FIG. 20 is a view similar to FIG. 19 but with the bar supporting means in plane.

FIG. 21 is a side elevation of the bar supporting means of FIG. 20.

FIG. 22 is a perspective of a boring bit adapted to form the recess of FIG. 19.

Figure 1:
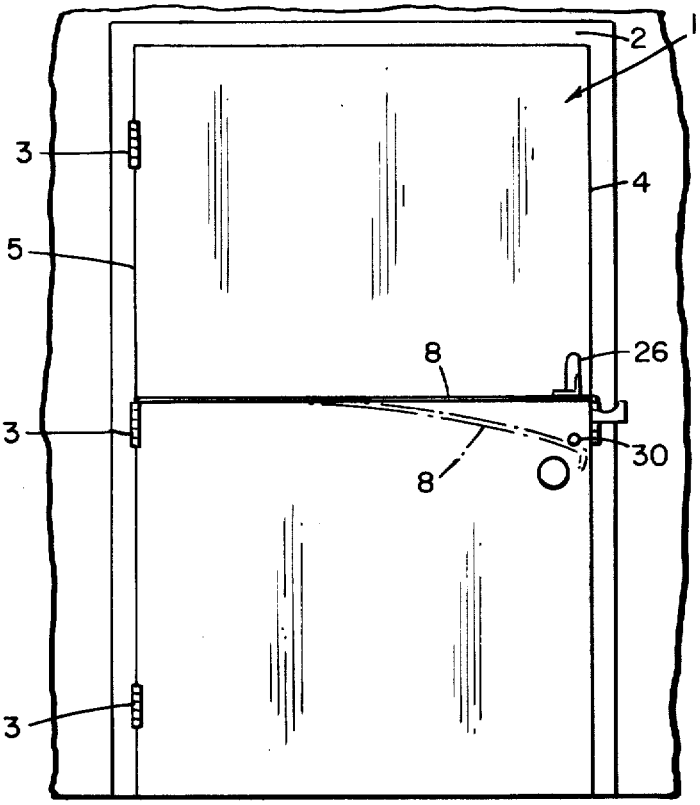
FIG. 1 is a side elevation of the interior side of a door structure showing the door and frame and the holding bar cooperating therewith.
Figure 3:
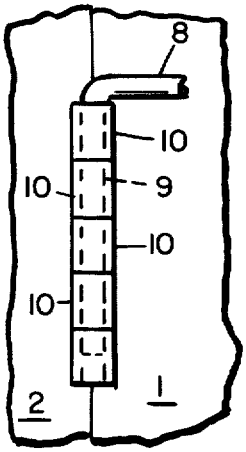
FIG. 3 is a greatly enlarged fragmentary view of the structure of FIG. 1 partially broken away and showing the holding bar in its inactive or inoperative position.
Figure 3:
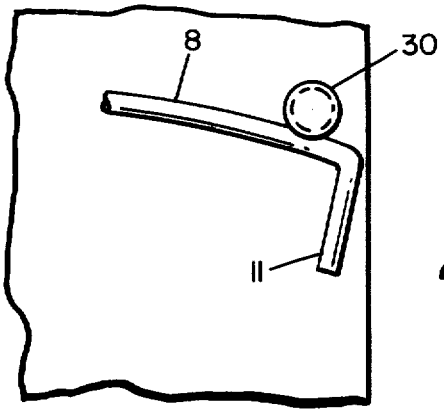
Figure 4:
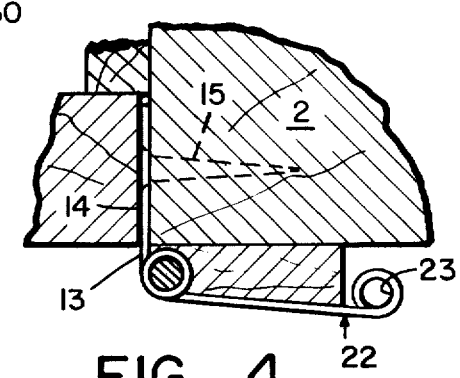
FIG. 4 is a horizontal section through the door and frame showing the keeper structure.

In detail, and first with reference to FIG. 1, the various forms of the invention will be shown in connection with a door generally designated 1 having a frame 2 to which are secured hinges 3 at the hinge edge of the door 1 and which door is adapted to be provided with a latch or lock (not shown) at the opposite latch edge 4 of the door. The auxiliary holding means for the door 1 in the structure of FIG. 1 comprises an elongated bar 8 which is formed at one end with a laterally offset portion 9 (FIG. 3) which may be received within the apertured ears 10 of the existing hinge structure. The opposite end of bar 8 is bent to provide another laterally offset portion 11 which, when the door is in locked condition, is adapted to be received within an apertured ear 12 formed on a keeper generally designated 13. This keeper 13 is preferably in the form of a generally rectangular flat plate 14 which may be firmly secured to the frame 2 by means of a plurality of screws 15 (FIG. 4). To provide additional strength, the keeper 13 is preferably provided with additional flanges 16 which may be bent substantially at right angles to plate 14 and secured to the frame 2 by means of screws 17.

Figure 5:
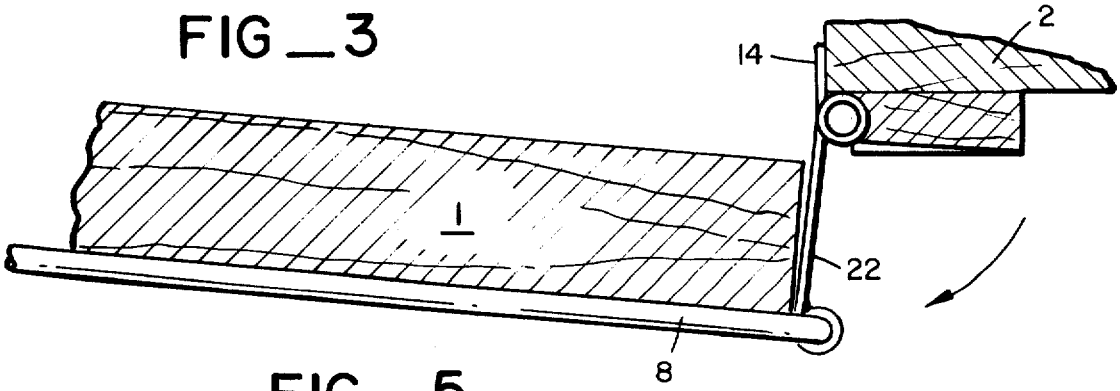
FIG. 5 is a fragmentary horizontal cross sectional view through the frame and door showing the latter in partially opened position.
Figure 23:
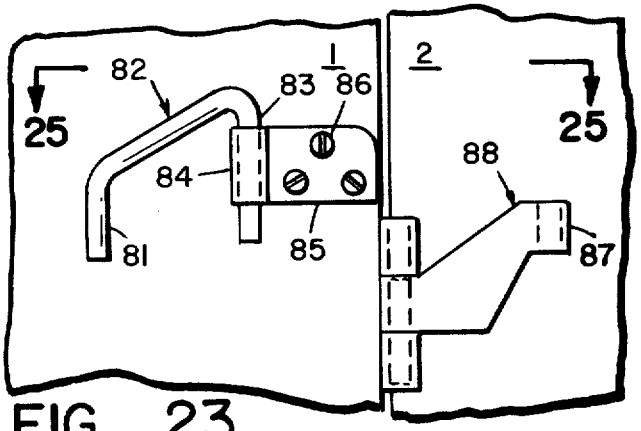
FIG. 23 is a fragmentary side elevation of the inside of a door structure showing another form of holding bar and keeper.
Figure 25:
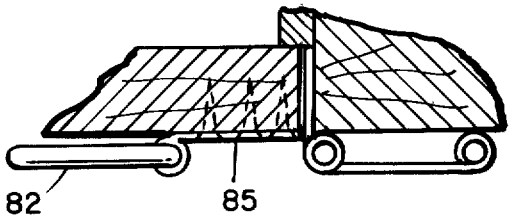
FIG. 25 is a horizontal section through the closure structure showing the device of FIG. 23.
Figure 26:
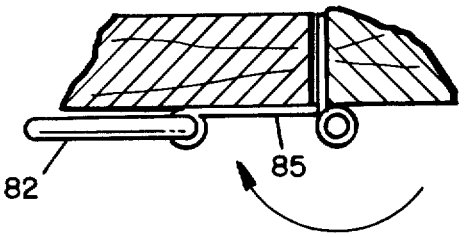
FIG. 26 is a view similar to FIG. 25 showing the structure in the position of FIG. 24.
Figure 24:
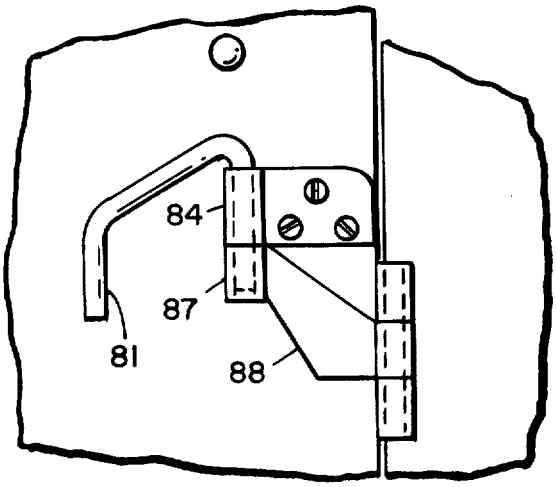
FIG. 24 is a view similar to FIG. 23 showing the holding bar in door holding position with the latter locked.

Spaced downwardly from apertured ear 12 is another similar apertured ear 20 in which is received a hinge pin 21 which serves to swingably support a second keeper generally designated 22. This second keeper is formed at its outer end to provide a bore 23 which is also adapted to receive the offset portion 11 of bar 8. As best seen in FIG. 5 the keeper 22 may be swung from the inactive position of FIG. 4 to the position of FIG. 5 so that the offset portion 11 of the bar 8 may be inserted in the bore 23 so as to hold the door in a partially opened position. This permits the user to speak through the opening between the door and the frame or receive articles from a person on the outside and at the same time prevent the door from being opened further by an intruder.

Figure 2:
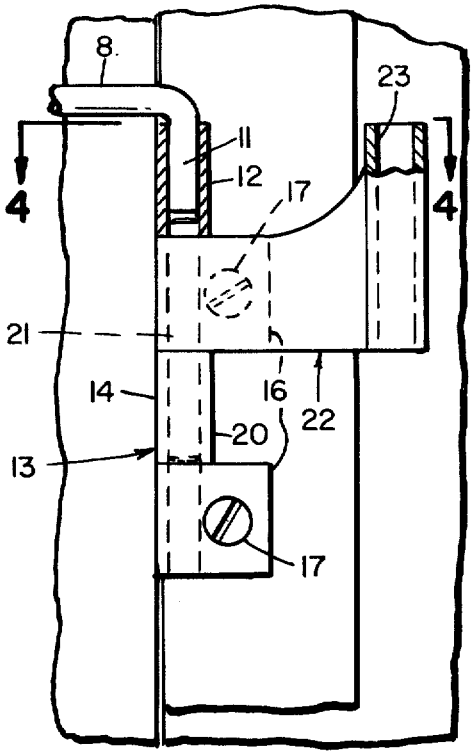
FIG. 2 is a greatly enlarged fragmentary side elevational view of the door structure showing the holding bar in its door holding position when the door is closed.

When the bar is in the locked position of FIG. 2, a lock generally designated 26 (FIG. 1) is preferably provided on the door to prevent the bar 8 from being swung upwardly from outside the door by introducing a thin element through the space between the door and the frame. This lock is best seen in FIGS. 6 and 7 and comprises a plate 27 swingably connected to the door 1 by means of a screw 28. The plate 27 may be provided with flanges 29 and engages the upper portion of bar 8 along its lower side. When not in use the lock 26 may be swung upwardly to an inoperative position shown in dot-dash lines in FIG. 6.

If it is desired not to employ the holding bar, the same may be held in an inoperative position by means of a catch 30 which may take the form of a rubber covered bumper secured to the door 1. As best seen in FIGS. 1 and 3, the rod 8 has enough resiliency because of its length to be bent downwardly to the dot-dash position of FIG. 1 and held in such position by catch 30.

Another form of the invention is shown in FIG. 8 wherein the door is provided only with upper and lower hinges and does not have a central hinge. In this case the bar 8 is received at its inner end in the ear 31 of a plate 32 secured to the door frame. In other words, one-half of a hinge may be employed. Similarly plate 33 (FIG. 9) may be fixed to the door frame adjacent the latch edge of the door. This plate is provided with ears 34 for receiving the outer end of the bar 8 or for receiving a keeper 22 similar to that shown in FIG. 2.

The bar 8 need not be positioned centrally of the height of the door but may be positioned at the upper hinge as indicated at dot-dash lines in FIG. 8.

Another method of securing the inner left hand end of the holding bar is shown in FIGS. 11, 12 wherein the bar 8' is not provided with an offset portion but is secured within a horizontally elongated clamping plate 40 fastened to the door 1 by means of screws 41. Said plate 40 is formed along its lower edge with a semicircular bent portion 42 so that the end of rod 8' may be clamped between said lower portion 42 and the door by means of screws 41. This structure provides a simple means for changing the effective length of the bar.

It will be noted that the structures shown in FIGS. 1 and 11 provide a holding bar of sufficient length so that the effort that may be exerted by an intruder on the bar at the inner end of the latter is very small and it is very unlikely that the holding means for said inner end can be broken. Furthermore, it will be noted that because of the manner in which the keeper 13 is secured to the frame, it would require an unusually large force to break the keeper structure away from the door frame.

Another modified form of the invention is shown in FIGS. 13 and 14. In this case the inner end 8A of the holding bar is formed with an offset portion 48 which replaces the hinge pin of a hinge structure 49 of the door. In this case the upper end of the offset portion 48 is threaded to receive a nut 50 for securing the holding bar in place. It will be noted that this structure prevents inadvertent release of the inner end of the bar.

In order to provide for adjustment of the effective length of the holding bar, the bar shown in FIG. 13 is provided in two separate portions 8A, and 8B. The inner end 8A may be fixedly secured by any desired means within one end of an elongated sleeve 51. The inner end of the bar 8B is slidably received within the opposite end of sleeve 51 so that the portion 8B of the bar may be slid inwardly or outwardly of the sleeve 51 in order that the outer end of the bar may be secured within the keeper. In order to prevent complete withdrawal of the portion 8B, the latter may be provided at its inner end with a slot 52 and the sleeve 51 formed to provide an indented portion 53 struck from the material of sleeve 51 and received within the slot 52. By this simple structure, adjustment of the effective length of the holding bar may be achieved, at the same time preventing complete withdrawal of the sliding portion 8B of the holding bar.

Yet another means for securing the outer end of the holding bar is shown in FIGS. 15, 16 wherein a relatively thin flat plate is bent to provide an apertured ear 56 and a double thickness portion 57 which may be secured to the frame 2 by means of screws 58. The material employed may be thin enough to fit in the gap between the door and frame thus obviating a recess in the frame. This relatively inexpensive structure is extremely strong and is effective in supporting the outer end of the holding bar when it is not desired to hold the door in a partially open position. Naturally the construction of FIGS. 15, 16 may also be employed when a second keeper is desired in accordance with the construction of FIG. 2.

Other methods of adjusting the effective length of the bar and securing the inner end thereof are shown in FIGS. 17, 18. In this case the inner end 8C is swingably connected by means of a pin 60 to the outer end of a hinge pin 61 received within the existing hinge structure. By this arrangement the entire holding bar structure may be swung away from the door so as to depend from the hinge pin 61 as shown in FIG. 18.

Another method of adjusting the effective length of the holding bar is shown in FIG. 17. In this case the outer end 8D of the holding bar is provided with a threaded end 65 threadedly secured within an internally threaded sleeve 66. The corresponding end of portion 8C of the holding bar is provided with a threaded end 67 threadedly received within the adjacent end of sleeve 66. The threads 65, 67 and the complementary threads in sleeve 66 may preferably be formed to the same hand but with different pitches so that portion 8D of the holding bar may be moved inwardly or outwardly by rotating the sleeve 66. By this structure a course adjustment may be obtained by rotating only portion 8D of the bar while a finer, vernier like, adjustment may be obtained by rotating sleeve 51.

An alternative form of support for the inner end of the holding bar is shown in FIGS. 19–21 wherein a shallow recess 70 is formed in the frame 2 by a boring bit of the type shown in FIG. 22. By providing a template (not shown) to position the center 71 for the boring bit of FIG. 22, a plurality of rounded shallow recesses may be formed of the type shown in FIG. 19. A plate 72 having an outline similar to the recess 70 may then be fitted within said recess and secured to the frame by means of screws 73. Of course the plate 72 is formed to provide the usual apertured portion 74 for receiving the laterally offset portion of the holding bar illustrated in FIG. 3. The boring bit of FIG. 22 may be generally conventional in form to include a central point 76 and a cutting blade 77. However, in this case the bit is provided with a sleeve 78 fixedly secured to the blade 77 so that the latter projects outwardly from the outer edge of sleeve 78 a distance equal to the depth of the recessed portion 70 (FIG. 19), thereby preventing the bit from boring too deep a hole in the frame.

Another form of the invention is shown in FIGS. 23–29. In this case the holding bar comprises a distorted U-shaped rod generally designated 82 which is provided with a long leg 83 received within the apertured portion 84 of a plate 85 secured by screws 86 to the inside of the door 1. The lower end of leg 83 of bar 82 is adapted to be received within the apertured portion 87 of a keeper generally designated 88 which is secured to the frame 2 in a somewhat similar manner as the keeper 22 of FIG. 2. This keeper 88 is adapted to be swung from the inactive position of FIG. 23 to the position of FIG. 24 so that the bar 82 may be raised upwardly from the position of FIG. 23 and then lowered so that the lower end of said leg 83 enters the apertured portion 87 of the keeper 88. It will be apparent that this structure provides a secure method of locking the door relative to the frame 2.

Figure 27:
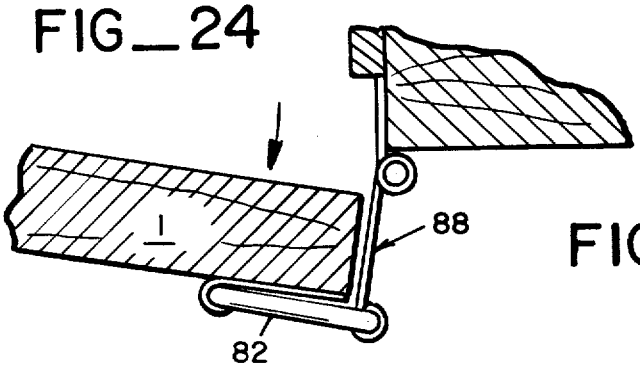
FIG. 27 is a horizontal section through the door structure showing the holding bar cooperating with the keeper to hold the door in partially open position.
Figure 28:
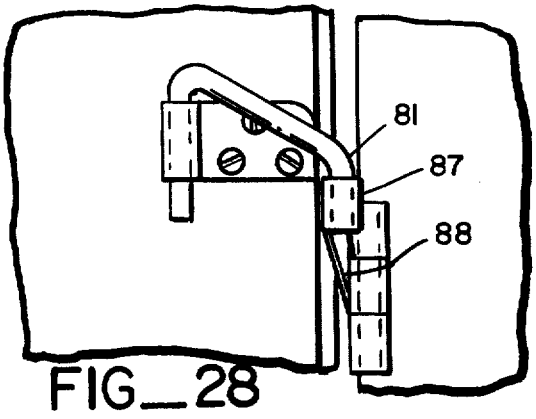
FIG. 28 is a side elevation of the structure of FIG. 27.
Figure 29:
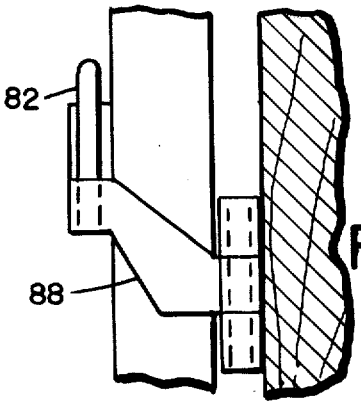
FIG. 29 is a vertical section through the door frame showing the structure of FIG. 28.

If it is desired to hold the door in partially opened position, the keeper 82 is swung to an intermediate position shown in FIGS. 27, 28 and the short leg 81 of bar 82 is secured within the apertured portion 87 of said keeper 88. It will be apparent that this provides a secure method of holding the door against further movement when the latter is in its partially opened position of FIGS. 27–29.

The various forms of the invention above disclosed provide an extremely effective and inexpensive means for holding a door against intruders. The simplicity of the arrangements shown permits a person having very little skill in carpentry to install the door holding bar.

I claim:

1. In combination with a door frame, and a door mounted therein having a hinge edge and an opposite latch edge, a safety latch for holding said door comprising:

an elongated bar provided at one of its ends with means to secure said bar to the door structure, said bar being formed at its other end with a laterally offset portion having a free end, a keeper mounted on said frame at the latch edge of said door, and formed to provide an opening for receiving said free end therein to prevent opening movement of said door from closed position, a second keeper mounted on said frame at said latch, said second keeper being adapted to receive said free end of said bar therein with said bar angularly disposed relative to the plane of said frame, whereby said door may be partially opened with said bar preventing further opening.

2. A safety bar according to claim 1 wherein a retainer is provided on said door adapted to cooperate with said bar to hold the latter in a bent position angularly disposed relative to its door holding position and parallel to the plane of said door.

3. The combination of claim 1 wherein said second keeper is swingably connected to said frame and is adapted to be swung from a position against said frame to a position extending outwardly therefrom for receiving said offset portion therein.

4. The combination of claim 3 wherein said second keeper is swingably connected to said first keeper.

5. The combination of claim 1 wherein said bar extends the entire width of said door, a retainer on said door adjacent said latch edge and adapted to cooperate with said bar to hold the latter in a bent position angularly disposed relative to its door holding position and parallel to the plane of said door.

6. The combination of claim 4 wherein said first keeper comprises a plate secured to said frame, said plate being formed to provide a recess outwardly of said frame for receiving said offset portion therein.

7. The combination of claim 1 wherein said one end of said bar is swingably secured to the inside face of said door.

* * * * *